US007451038B2

(12) United States Patent
Kosiedowski et al.

(10) Patent No.: US 7,451,038 B2
(45) Date of Patent: Nov. 11, 2008

(54) METHOD FOR DETECTING THE OPENING OF A PASSIVE PRESSURE LIMITING VALVE

(75) Inventors: Uwe Kosiedowski, Owingen (DE); Martin Bucher, Bermatingen (DE); Armin Dölker, Friedrichshafen (DE); Volker Wachter, Mengen-Beuren (DE)

(73) Assignee: MTV Friedrichshafen GmbH, Friedrichshafen (DE)

( * ) Notice: Subject to any disclaimer, the term of this patent is extended or adjusted under 35 U.S.C. 154(b) by 0 days.

(21) Appl. No.: 11/895,112

(22) Filed: Aug. 23, 2007

(65) Prior Publication Data

US 2008/0103674 A1 May 1, 2008

(30) Foreign Application Priority Data

Aug. 29, 2006 (DE) ..... 10 2006 040 441

(51) Int. Cl.
*F02D 41/00* (2006.01)
*F02M 63/02* (2006.01)

(52) U.S. Cl. ..... 701/103; 123/506

(58) Field of Classification Search ..... 701/103–105; 123/456, 457, 462, 480, 506
See application file for complete search history.

(56) References Cited

U.S. PATENT DOCUMENTS 5,700,136 A * 12/1997 Sturman ..... 123/506

FOREIGN PATENT DOCUMENTS

DE 103 30 466 B3 10/2004
EP 1 018 600 A2 * 7/2000

* cited by examiner

*Primary Examiner*—Hieu T Vo
(74) *Attorney, Agent, or Firm*—Klaus J. Bach

(57) ABSTRACT

In a method for detecting the opening of a passive pressure limiting valve for releasing fuel from a common rail fuel injection system to a tank with a fuel supply including a throttle wherein, based on a stationary rail pressure present during manual operation, a load reduction is detected when the rail pressure exceeds a first limit value and, as a result, a PWM signal for controlling the suction throttle is temporarily increased, the opening of the pressure limiting valve is recognized if, as a result, the rail pressure exceeds a second limit value and increases still further.

10 Claims, 7 Drawing Sheets

METHOD FOR DETECTING THE OPENING OF A PASSIVE PRESSURE LIMITING VALVE

BACKGROUND OF THE INVENTION

The invention resides in a method for detecting the opening of a passive pressure limiting valve for the release of fuel from a common rail fuel injection system to a fuel tank wherein, during normal operation, a load reduction is recognized when the rail pressure exceeds a limit value and, as a result, a PWM (Pulse Width Modulation) signal is generated for temporarily applying to a suction throttle a control signal with a PWM value which is increased over the value provided during normal operation.

In a common rail fuel injection system, a high pressure pump supplies pressurized fuel to a rail. The fuel supply line cross-section to the high pressure pump is controlled by a variable suction throttle. The rail is in communication with fuel injectors by way of which the fuel is injected into the combustion chambers of the internal combustion engine. Since the quality of the combustion depends to a large extent on the pressure level in the rail, the pressure level is controlled. The high-pressure control circuit comprises a pressure controller, the suction throttle with high pressure pump and the rail and also a back coupling branch including a filter. In this high pressure control circuit, the pressure level in the rail corresponds to the control value. The pressure values as measured in the rail are converted via the filter to an actual rail pressure and compared with a desired rail pressure. The control deviation obtained thereby is converted via the pressure controller to a control signal of the suction throttle. The control signal corresponds for example to a volume flow with the unit liter/minute. Typically, the control signal is in the form of an electrical PWM signal (pulse-width modulated). The high pressure control circuit described above is known from DE 103 30 466 B3.

For protection from an excessive pressure level, the rail is provided with a passive pressure limiting valve. When the pressure level exceeds a predetermined value, the pressure limiting valve opens whereby fuel is released from the rail and returned to the fuel tank.

In practice, the following problem can occur: During a load reduction the engine speed increases momentarily. An increasing engine speed causes, with a constant desired engine speed, an increased speed control deviation. This causes a speed controller to reduce the control value for the fuel injection amount. A lower fuel injection amount again results in less fuel being taken out of the rail whereby the fuel pressure level in the rail is rapidly increased. Complicating the process is the fact that the pumping volume of the high pressure is speed dependent. An increase in the engine speed results in an increased pumping volume and, consequently, additionally increases the pressure in the rail. Since the high-pressure control has a comparatively long reaction time, the rail pressure can increase to such an extent that the pressure limiting valve opens for example at 1950 bar. As a result, the rail pressure drops for example to a value of 800 bar. At this pressure level, an equilibrium state between the pumped fuel and the released fuel amount is established so that the rail pressure does not drop any further. As a result of the pressure loss, the efficiency of the internal combustion engine drops while, at the same time, the exhaust gas become visibly murky.

The not-pre-published German patent application DE 10 2006 029 138.4 proposes a method wherein, upon recognizing a load reduction, the rail pressure is controlled by setting the PWM signal temporarily to a value which is higher than it would be under normal operation. By increasing the power supply energy to the suction throttle, the dynamics of the control member are increased, whereby an unintentional opening of the pressure limiting valve is suppressed while a suction throttle slide which is hard to move can nevertheless be operated.

However, with failures such as a cable breakage or a suction throttle plug not being correctly locked in position or a suction throttle slide member permanently locked up this method is ineffective so that the pressure limiting valve opens unexpectedly when the rail pressure increases.

It is therefore the object of the present invention to safely recognize an undesired opening of the passive pressure limiting valve of a common rail fuel injection system.

SUMMARY OF THE INVENTION

In a method for detecting the opening of a passive pressure limiting valve for releasing fuel from a common rail fuel injection system to a tank with a fuel supply including a throttle wherein, based on a stationary rail pressure present during manual operation, a load reduction is detected when the rail pressure exceeds a first limit value and, as a result, a PWM signal for controlling the suction throttle is temporarily increased, the opening of the pressure limiting valve is recognized if, as a result, the rail pressure exceeds a second limit value and increases still further.

In praxis, to this end, the rail pressure is compared with a second limit value of for example 1920 bar. This limit value is so selected that, during normal operation, the rail pressure does not exceed this pressure level.

Embodiments are considered wherein an opening of the pressure limiting valve is recognized when subsequently the rail pressure drops with a strongly negative pressure gradient, for example minus 5000 bar per second, or a rail pressure control deviation is outside a given tolerance band or when the set value calculated by the pressure controller for a given period corresponds either to a fixed or an operating point-dependent maximum or minimum value. The methods according to the various embodiments can also be performed without temporary PWM increase.

Upon recognizing an opening of the pressure limiting valve, this is indicated to an operator and as action advice a power reduction, the establishment of idling operation or an emergency stop is recommended.

Installation of the method according to the invention does not require any change in hardware nor any additional sensors, since outer signals which are already available are utilized. Therefore the method according to the invention can be introduced as a retrofit to the program of an electronic engine control system already in operation. As a result, the installation is almost cost-neutral.

The invention will become more readily apparent from the following description of a preferred embodiment thereof described below on the basis of the accompanying drawings:

DESCRIPTION OF A PREFERRED EMBODIMENT

Figure 1:
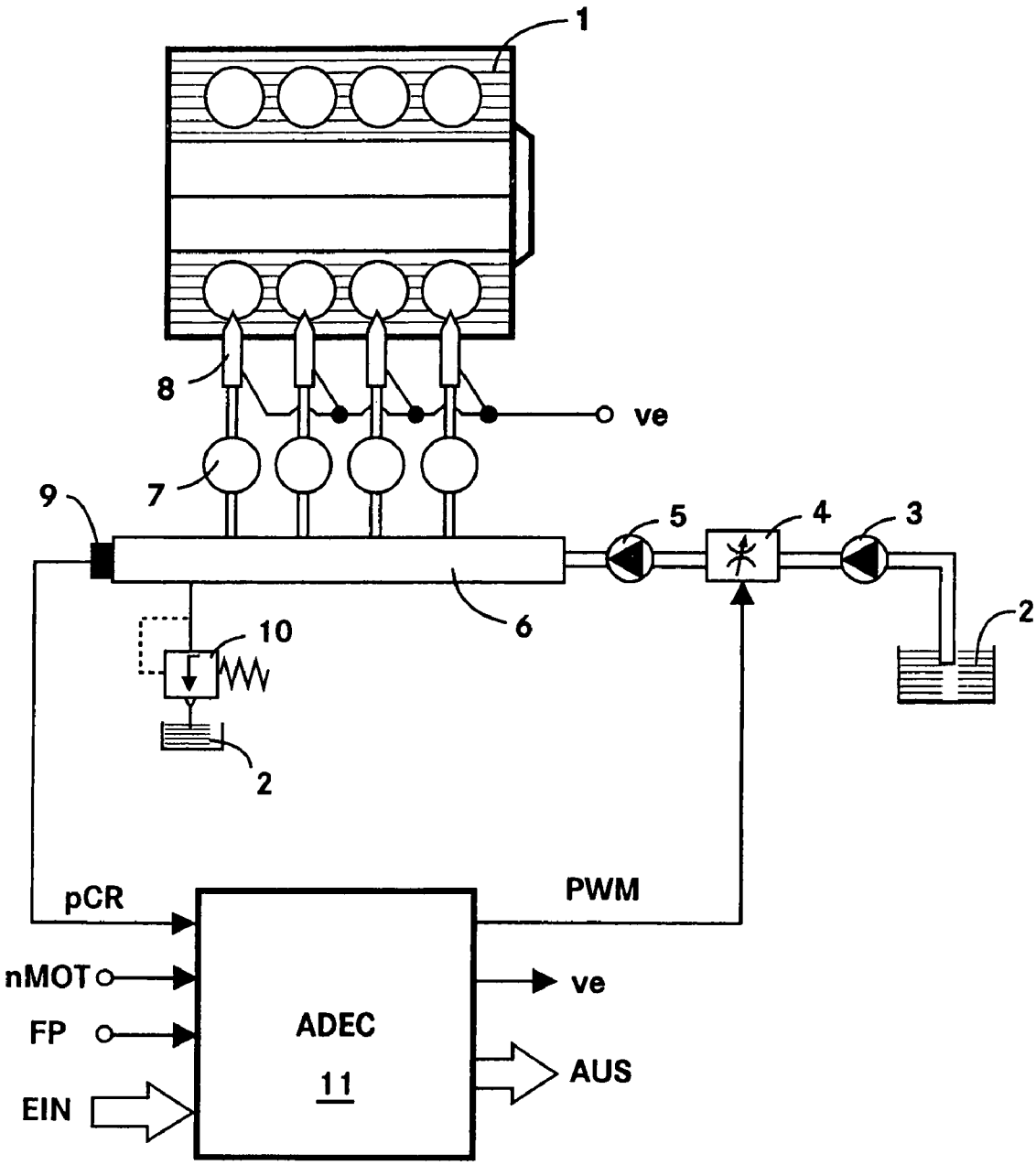
FIG. 1 shows schematically an internal combustion engine with a common rail system.

FIG. 1 shows an internal combustion engine with a common rail fuel injection system. The common rail fuel injection system comprises the following components: A low pressure pump 3 for pumping fuel from a fuel tank 2, a controllable suction throttle 4 for influencing the fuel volume flow, a high-pressure pump 5 for pumping the fuel while increasing its pressure, a rail 6 and individual storage chambers 7 for storing the fuel and injectors 8 for injecting the fuel into the combustion chambers of the internal combustion engine 1.

This common rail system is operated with a maximum stationary rail pressure of for example 1800 bar. For protection from an inadmissibly high pressure level in the rail 6 a passive pressure-limiting valve 10 is provided, which opens at a pressure level of for example 1950 bar. When it opens, fuel is released from the rail 6 via the pressure limit valve 10 to the fuel tank 2 in a controlled manner. As a result, the pressure level in the rail 6 drops to a value of for example 800 bar.

The operation of the internal combustion engine is controlled by an electronic control unit (ADEC) 11. The electronic control unit 11 includes the usual components of a microcomputer system, such as for example, a microprocessor, I/O components, buffer and storage components (EEPROM, RAM). In the storage components, the operational data relevant for the operation of the internal combustion engine are deposited in the form of performance graphs or characteristic curves. By way of these data, the electronic control system 11 calculates from the input values the output values. In FIG. 1, for example, the following input values are shown: The rail pressure pCR, which is measured by way of a rail pressure sensor 9, an engine speed nMOT, a signal FP representing the power requirements of the operator and an input value EIN. In the input value EIN for example, the charge air pressure of the exhaust gas chargers and the temperatures of the coolant and the lubricants as well as the fuel may be added up.

FIG. 1 shows as output values of the electronic control unit 11 a signal PWM for controlling the suction throttle 4, a signal ve for controlling the injectors 8 and an output value AUS. The output value AUS is representative of the other control signals for controlling the internal combustion engine 1, for example a control signal for the activation of a second exhaust gas turbocharger of a register charger arrangement.

Figure 2:
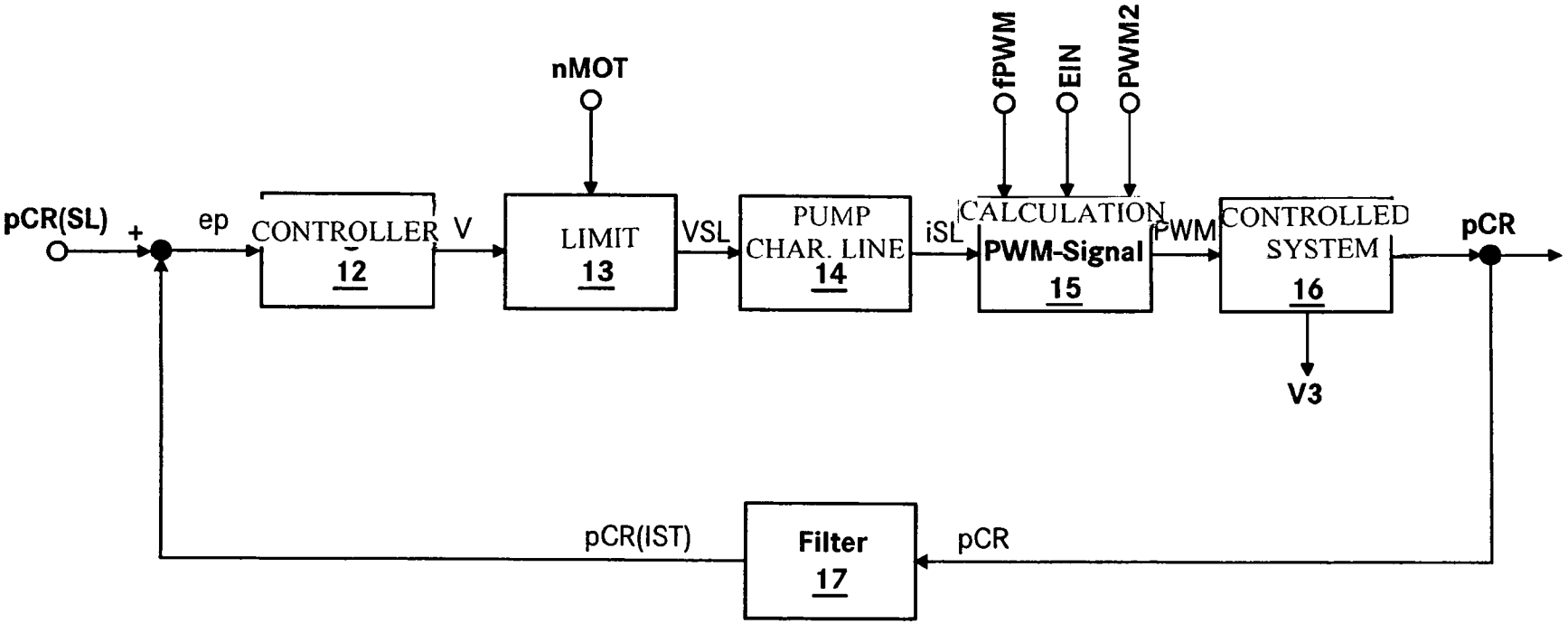
FIG. 2 shows a pressure control circuit.

FIG. 2 shows a pressure control circuit. The input values are a desired rail pressure pCR(SL), the engine rotational speed nMOT, a base frequency fPWM for the PWM signal, a PWM signal PWM2, and a value EIN, for example, a battery voltage. The output value corresponds to the raw value of the rail pressure pCR. From the raw pressure value pCR, an actual rail pressure pCR(IST) is determined by means of a filter 17. This value is compared with the desired value pCR (SL) at a summation point whereby a control deviation ep is provided. From the control deviation ep, a control value is determined by means of a pressure controller 12. The control value corresponds to a volume flow V. The physical unit of the volume flow is liter/minute. Optionally, the calculated desired consumption is added to the volume flow V. The volume flow V corresponds to the input value for a limit 13. The limit 13 can be speed-dependent, nMOT. The output value of the limit 13 corresponds to a desired volume flow VSL which represents the input value of a characteristic curve 14 for the pump. Via the characteristic line 14 for the pump, a desired electric current iSL is assigned to the desired volume flow VSL. The desired current iSL is then converted in a calculation 15 to a PWM signal PWM. The PWM signal herein represents the switch-on duration and the frequency fPWM corresponds to the base frequency. The signal PWM2 corresponds to a temporary settable PWM value which is higher than that used for normal operation, for example, by 80% and which is provided when a load reduction has been recognized. In the conversion, variations of the operating voltage and the fuel pre-pressure are taken into consideration. Then the PWM signal PWM is applied to the magnetic coil of the suction throttle. In this way, the travel distance of the magnetic core is changed whereby the pumping flow of the high pressure pump is influenced. The high pressure pump, the suction throttle, the rail and the individual storage devices represent a controlled system 16. From the rail 6, a desired consumption volume flow V3 is removed via the injectors 8. At this point, the control circuit is closed.

Figure 3A:
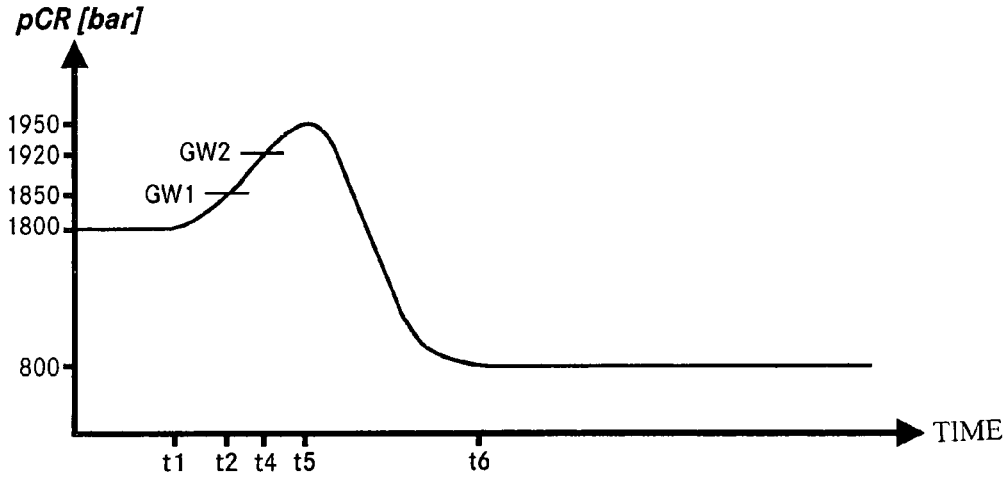
FIGS. 3A and 3B show time-based diagrams.
Figure 3B:
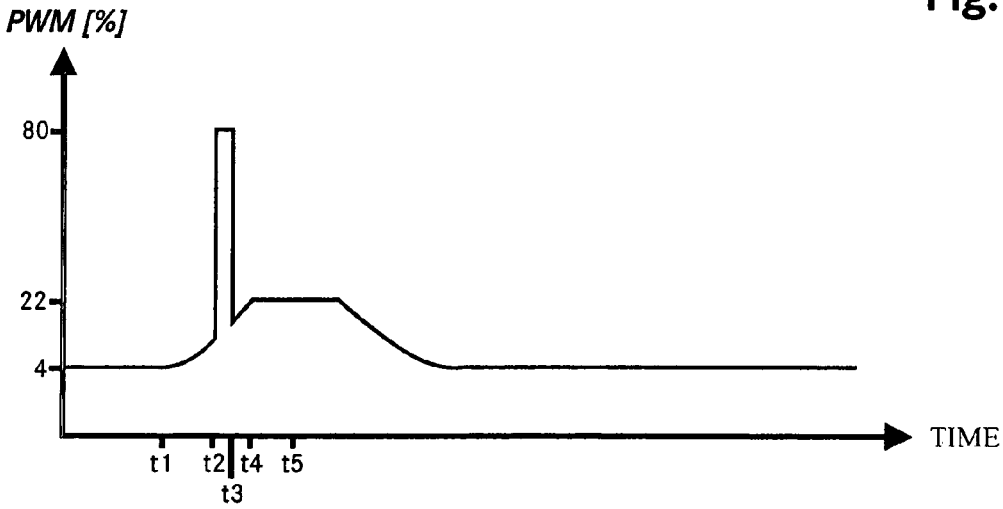

FIGS. 3A and 3B show the rail pressure pCR in bar and, respectively, the PWM signal in percent over time. At a point in time t1, the internal combustion engine is operating normally. The rail pressure pCR is 1800 bar which is the maximum pressure under stationary conditions. Because of a load reduction, the rail pressure pCR begins to raise with increasing t1. A load reduction occurs for example in connection with a ship drive during emerging of the ship propellers from the water or upon switching off of a generator load in connection with an emergency power generation unit. If the rail pressure pCR exceeds a first limit value GW1 in this case 1850 bar, at the time in point t2, for the period t2/t3, the PWM-signal is temporarily set to a higher value, shown here as 80% (FIG. 3B). After a certain period, for example, 10 ms, at t3, the PWM signal is returned to the normal operating value which, as a result of the increasing control deviation, is higher than it was before the activation. In further considerations, it is assumed that the temporary PWM increase cannot prevent a further increase of the rail pressure pCR. The reason may be a broken cable an incorrectly locked suction throttle plug or a locked suction throttle valve slide. Upon exceeding a second limit value GW2, in this case 1920 bar, at t4, the opening of the pressure limit value is recognized. The open pressure limiting valve causes a large reduction of the rail pressure pCR at the point in time t5. Beginning at t6, the equilibrium state of pumped fuel and returned fuel is established as described earlier.

Upon recognizing the unintended opening of the pressure limiting valve, the operator is informed about the occurrence of the malfunction and a certain action is recommended, for example, a lowering of the load demand, the establishment of idling operation or an emergency stop.

Figure 4:
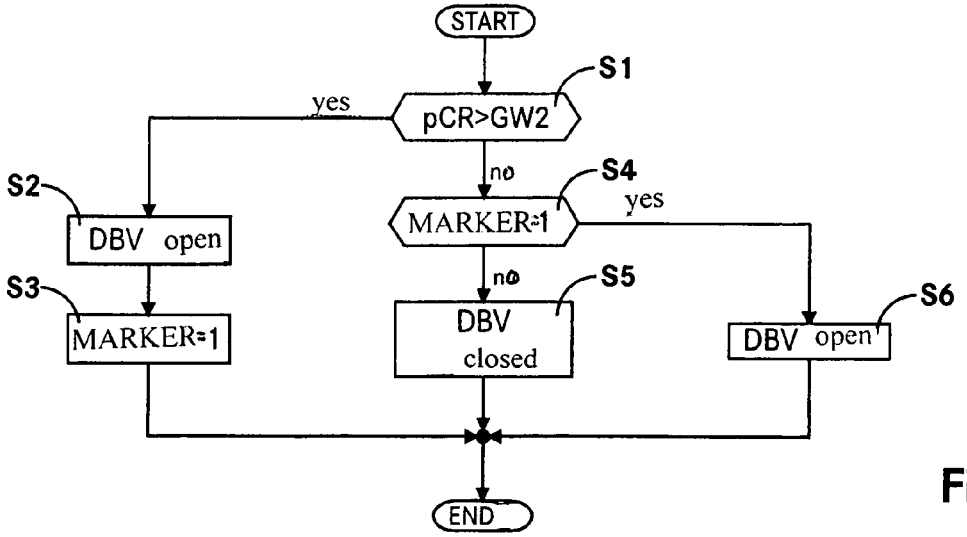
FIG. 4 shows a program cycle with respect to FIGS. 3A, 3B.

FIG. 4 shows a program performance diagram for FIG. 3. After the start of the program, it is examined at S1 whether the rail pressure pCR exceeds the second limit value GW2, here 1920 bar. If the rail pressure pCR is below the second limit value GW2 with the interrogation result S1=no, at S4, the value of a marker is examined. If its value is zero, it is determined at S5 that the pressure limiting valve is closed and this program part is terminated. If the examination at S4 shows that the marker is set (value 1), at S6, it is determined that the pressure limiting valve is open and this program part is terminated.

If the examination at S1 shows that the rail pressure pCR is greater than the second limit value GW2, that is, the interrogation result S1 is yes, it is determined at S2 that the pressure limiting valve is open, that at S3 the marker is set and this program part is terminated.

Figure 5:
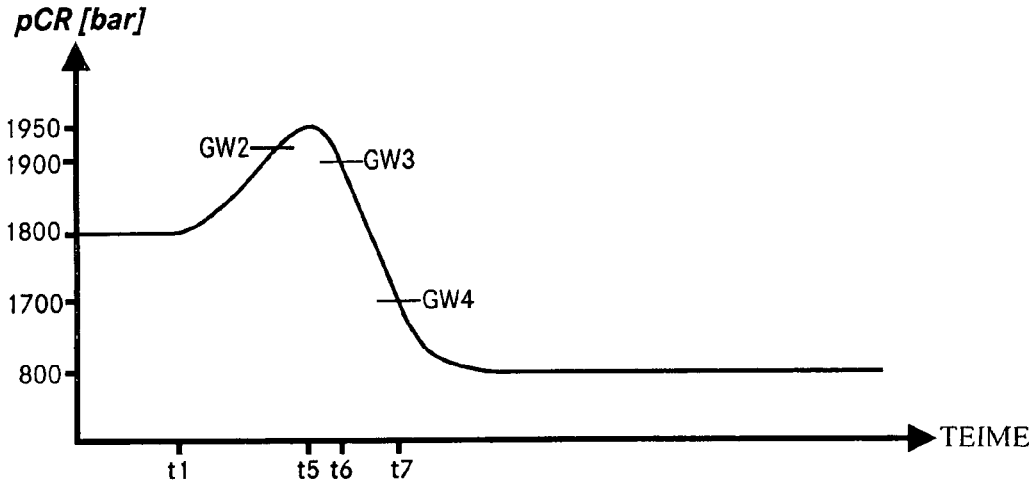
FIG. 5 shows a time-based diagram.
Figure 7:
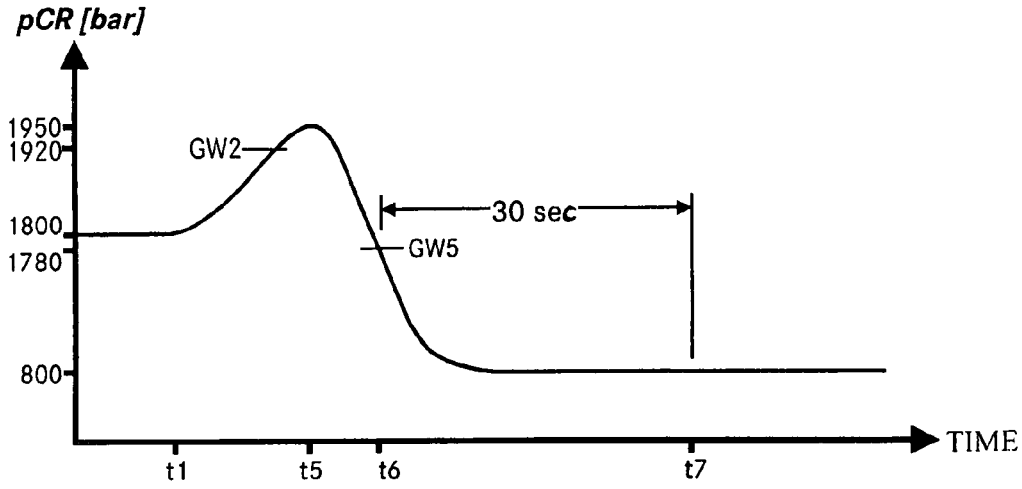
FIG. 7 shows a time-based diagram.
Figure 9A:
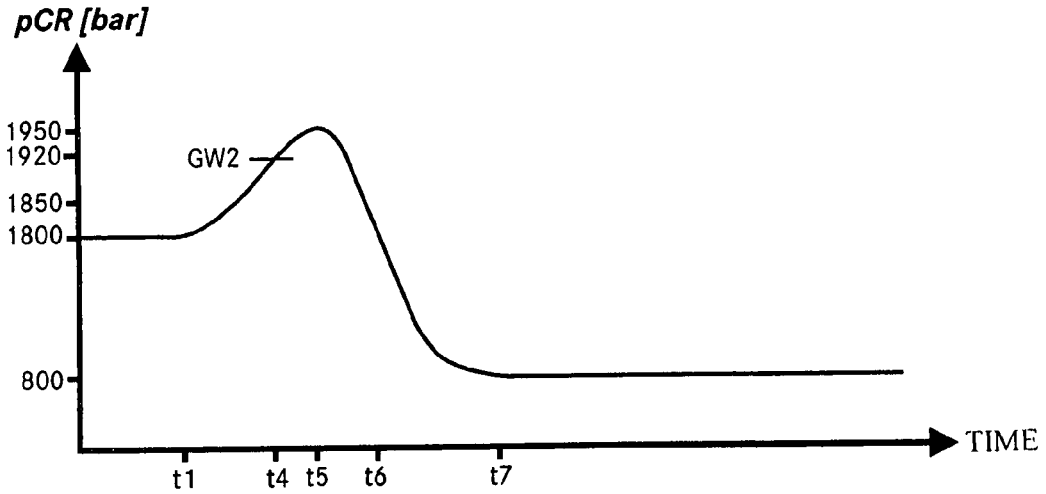
FIG. 9 shows a time-based diagram.

In the additional FIGS. 5, 7, and 9A, the course for the rail pressure pCR is identical with the course shown in FIGS. 3A, 3B. The embodiments shown in these figures are applicable in those cases where, upon recognizing a load reduction, an increased PWM signal corresponding to the FIGS. 3A, 3B is issued and also for the case in which no increased PWM signal issued.

FIG. 5 shows the rail pressure pCR over the time. Its course and the time marks t1 to t5 are the same as shown in FIGS. 3A, 3B. Beginning at t5, the rail pressure pCR becomes much smaller because the pressure limiting valve is open. As soon as the rail pressure pCR drops below a third limit value GW3, here: 1900 bar, at t6, the rail pressure gradient GRAD is evaluated. An opening of the pressure limiting valve is recognized, if the rail pressure gradient GRAD is strongly negative and larger than a predeterminable value, for example, 5000 bar/s. If the rail pressure pCR drops below a fourth limit value GW4 at a time t7, the evaluation of the rail pressure gradient GRAD is terminated. Upon opening of the pressure limiting valve, the rail pressure pCR drops to a load-dependent pressure level which is higher the lower the load is. With zero load, this pressure level is at about 1500 bar. Therefore the rail pressure gradient GRAD is monitored only within the pressure range defined by the two limit values GW3 and GW4.

Figure 6:
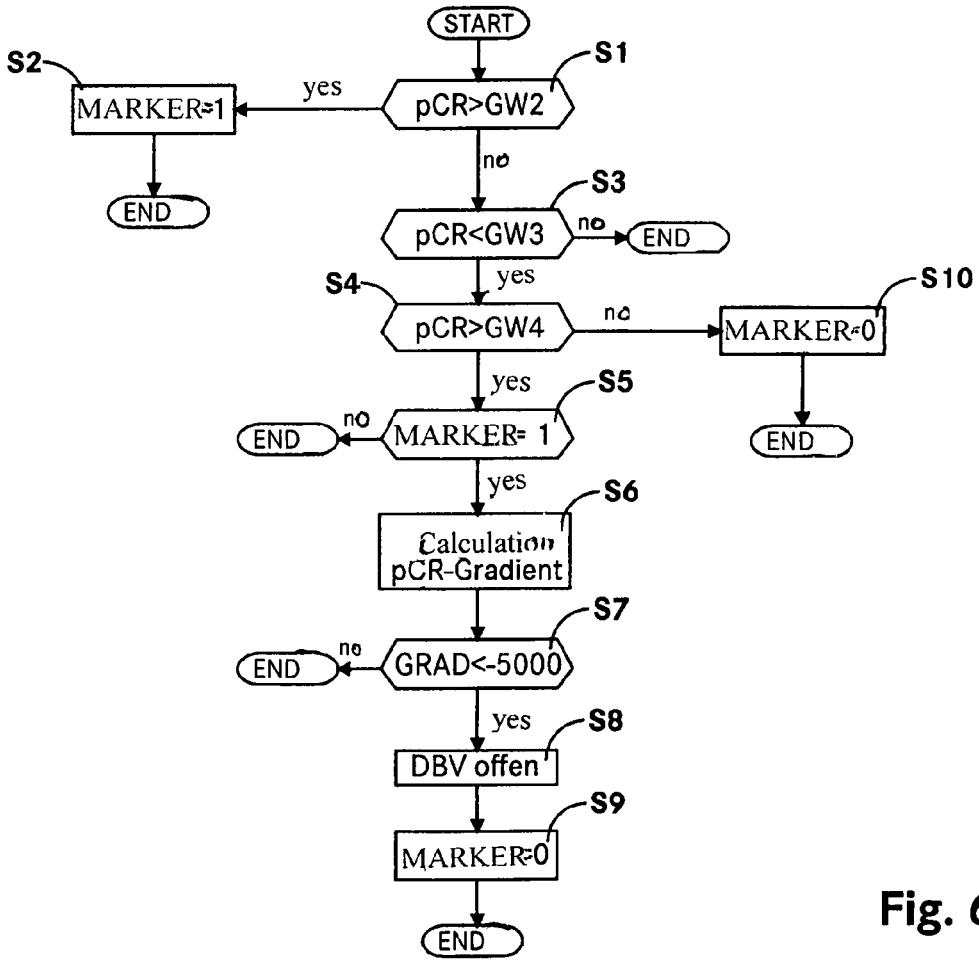
FIG. 6 shows a program cycle with respect to FIG. 5.

FIG. 6 shows a program diagram for FIG. 5. After the start of the program, it is examined at S1 whether the rail pressure pCR is greater than the second limit value GW2, here 1920 bar. If this is the case, interrogation result S1=yes, at S2 a marker is set to the value 1 and this program part is terminated. If the rail pressure pCR is below the second limit value GW2, interrogation result S1: no, at S3, it is examined whether the rail pressure pCR is smaller than the limit value GW3. The third limit value is the start value, here 1900 bar, for the evaluation of the rail pressure gradient GRAD. If the rail pressure pCR is still larger than the third limit value GW3, this program part is terminated. If the examination at S3 shows that the rail pressure pCR is lower than the third limit value GW3, interrogation result S3=yes, it is examined at S4 whether the rail pressure pCR has fallen below the fourth limit value GW4. The fourth limit value GW4, here 1700 bar, is the end value for the monitoring of the rail pressure gradient GRAD. The two limit values GW3 and GW4 define the surveillance range.

If the rail pressure is below the fourth limit value GW4, interrogation result S4=no, the marker is set at S10 to zero and this program part is terminated. If the rail pressure is still above the fourth limit value GW4, at S5 the value of the marker is inquired. If it is zero that is, the interrogation result S5 is no, this program part is terminated. If the marker has the value one, interrogation result S5=yes, at S6, the rail pressure gradient GRAD is calculated and, subsequently, it is examined at S7 whether this value is greater than a predeterminable value, for example −5000 bar/s. If this is not the case, interrogation result S7=no, this program part is terminated. If the rail pressure drops very rapidly, that is, there is a high gradient GRAD, interrogation result S7=gas, it is determined at S8, that the pressure limiting valve is open, at S9 the marker is assigned the value zero and then this program part is terminated.

The FIG. 7 shows the rail pressure pCR in bar over time. Its course and the time makers t1 to t5 are the same as in FIG. 3.

At the point in time t5, the rail pressure pCR drops rapidly because the pressure limiting valve is open. When the rail pressure pCR drops below a fifth limit value GW5, here 1780 bar, for example, at the point in time t6, the rail pressure control deviation is evaluated. If the rail pressure pCR has previously passed the value 1920 bar and if the rail pressure control deviation is up to the point in time t7 continuously greater than for example 20 bar, the opening of the pressure limiting valve is recognized, point in time t7.

Figure 8:
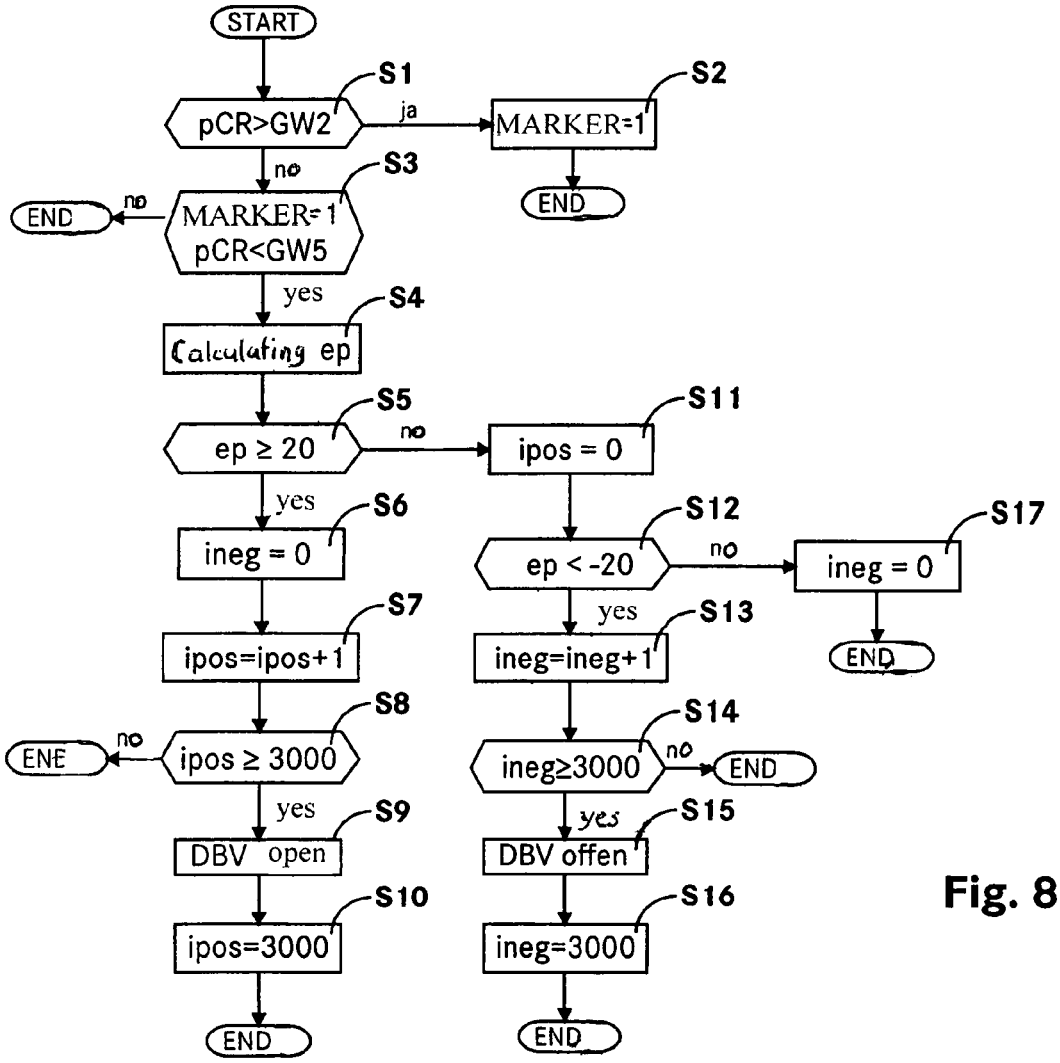
FIG. 8 shows a program cycle with respect to FIG. 7.

FIG. 8 shows a program diagram for FIG. 7. After the start of the program, it is examined at S1, whether the rail pressure pCR is greater than the second limit value GW2, here 1920 bar. If this is the case, interrogation result S1=yes, at S2, the marker is set to one and this program part is terminated. If the rail pressure pCR does not exceed the second limit value GW2, interrogation result S1=no, at S3, the value of the marker is inquired. If it is zero, interrogation result S3=no, this program part is terminated.

If at S3, the evaluation shows that the marker is one and the rail pressure pCR is smaller than the fifth limit value GW5, at S4, the control deviation cp is calculated from the desired and the actual rail pressure and it is examined at S5 whether it is greater than 20 bar. If this is the case, the program part S6-S10 is entered. If the control deviation is less than 20 bar, the program part S11 to S16 is entered.

If the control deviation ep exceeds 20 bar, interrogation result S5=yes, at S6, a negative counter ineg is set to the initialization value zero. At S7, the counter state of a counter ipos is increased by one. Then it is examined at S8, whether the value of the counter ipos is greater or equal, the value 3000. Since the sensing time was based on 10 ms a time stage of 30 seconds is obtained, see FIG. 7. With a counter state of less than 3000, this program part is terminated. If the time step is ended, interrogation result S8=yes, at S9, it is determined that the pressure limiting valve is open. This corresponds in FIG. 7 to the point in time t7. At S10, the counter ipos is then set to the value 3000 and this program part is terminated.

If the examination in S5 indicates that the control duration ep is lower than, or equal to, 20 bar, interrogation result at S5=no, at S11 the counter ipos is set to zero and at S12, it is examined whether the control duration ep is smaller than −20 bar. If this is the case, at S13, the counter ineg is increased by an increment of one. Then, at S14, the negative counter ineg is interrogated for the end value 3000. If this end value has not been reached yet, this program part is terminated. If it is determined at S14 that the counter end state has been reached, it is determined at S15 that the pressure limiting valve is open. At S16, the counter ineg is then set to this value 3000 and the program part is terminated.

If at S12, it has been determined that the control deviation ep is not smaller than −20 bar, interrogation result S12=no, the counter ineg is set at S17 to zero and this program part is terminated.

The embodiment shown in FIG. 9 is based on the recognition that, with a constant positive rail pressure control deviation ep, that is, the actual rail pressure—PCR(IST) drops below the level of the desired rail pressure pCR(SL), the I-component of the pressure controller becomes steadily larger. This means that the control value, that is, the volume flow, increases with a positive control deviation until it is limited to its maximum value by the limitation—reference numeral 13 in FIG. 2. Accordingly, then the desired current iSL is calculated by the pump characteristic line to be zero. An opening of the pressure limiting valve is therefore recognized if, with a constant positive control deviation ep, the desired volume flow VSL corresponds for a certain period to the maximum value or, alternatively, the desired current iSL corresponds for a certain period to the minimum value.

In the opposite case, with a constant negative rail pressure, control deviation ep, that is, the actual rail pressure pCR (IST) remains above the level of the desired rail pressure PCR(SL), the I-content of the pressure controller remains always smaller. This means that the control value, that is the volume flow, drops with a negative control deviation down to zero. In accordance therewith, the desired current iSL is then limited to its maximum value. In this case, then an opening of the pressure limiting valve is recognized when, during a constant negative control deviation ep, the desired volume flow VSL corresponds over a certain period to the minimum value or, alternatively, the desired current iSL corresponds for a certain period to the maximum value.

Figure 9B:
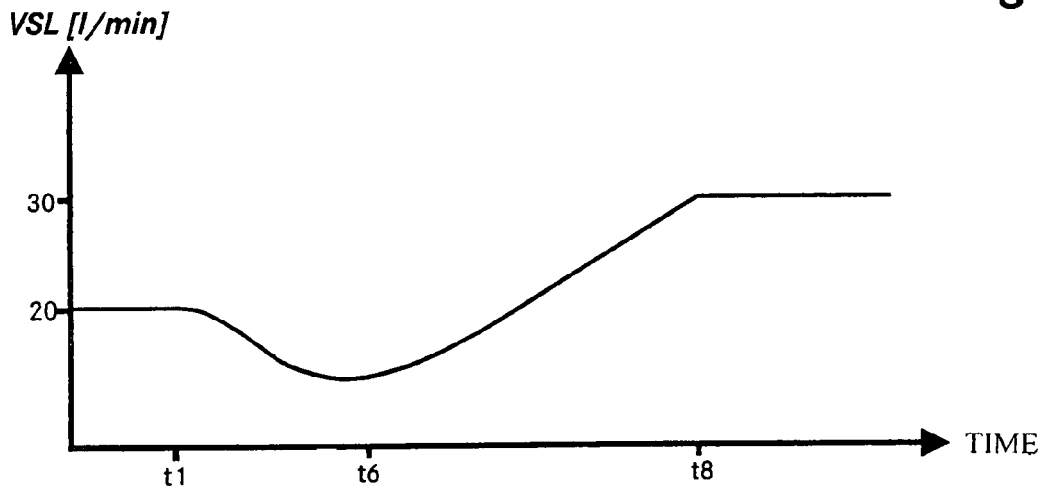
Figure 9C:
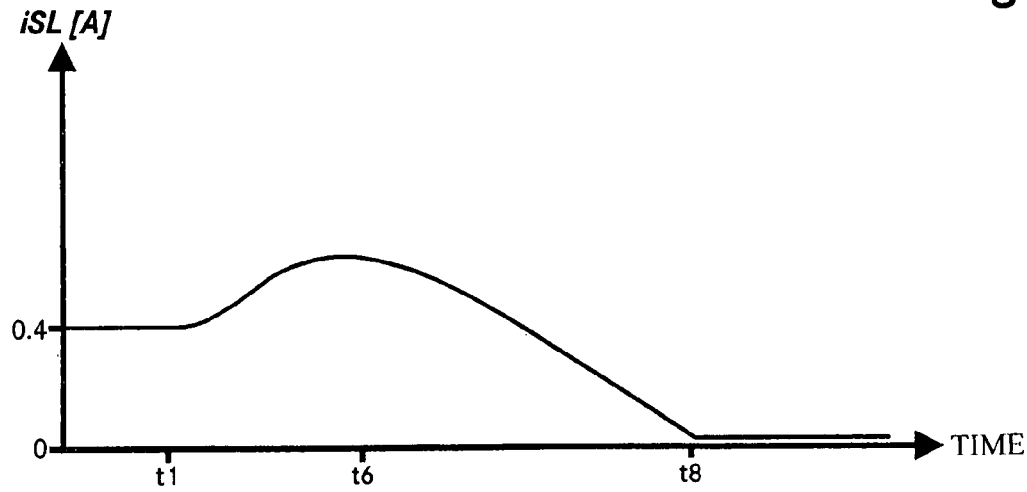

In FIGS. 9A to 9C, the first case, that is a continuous positive rail pressure control deviation, is shown. FIG. 9A to 9C show each, over time, the rail pressure pCR (FIG. 9A), a desired volume flow VSL, unit liter/minute, as control value of the pressure controller (FIG. 9B) and a desired current iSL, which is determined from the characteristic pump line from the control value of the pressure controller (FIG. 9C). The time marks t1 to t5 and the rail pressure pCR curve are identical for the representation of FIG. 3. The representation of FIG. 9 is based on a constant desired rail pressure pCR(SL) of 1800 bar.

An increase of the rail pressure pCR up to the point in time t5 results in a decreasing control deviation ep. The desired volume flow VSL reflects this qualitatively as it becomes smaller and smaller starting from the initial value, here 20 liter/minute. Also, the desired current iSL shows a corresponding course as it increases starting from an initial value 0.4 A. Based on the open pressure limiting valve, the rail pressure rapidly drops beginning at t5. At t6, the actual rail pressure corresponds to the desired rail pressure, so that the control deviation ep is zero. Beginning at the point in time t6, the control deviation becomes positive. From t7 on, the control deviation ep is maximal, here 1800 bar minus 800 bar. Since a positive control deviation ep results in an increasing I-component of the pressure controller the desired volume flow VSL increases until, at t8, it is limited to the maximum value of 20 liter/minute. The desired current iSL corresponds to this course and the limitation and has, at t8, the value zero. An opening of the pressure limiting valve is recognized when the desired volume flow VSL corresponds for a predeterminable time, for example 30 seconds, to the maximum value or the desired current iSL corresponds to the maximum value.

Figure 10:
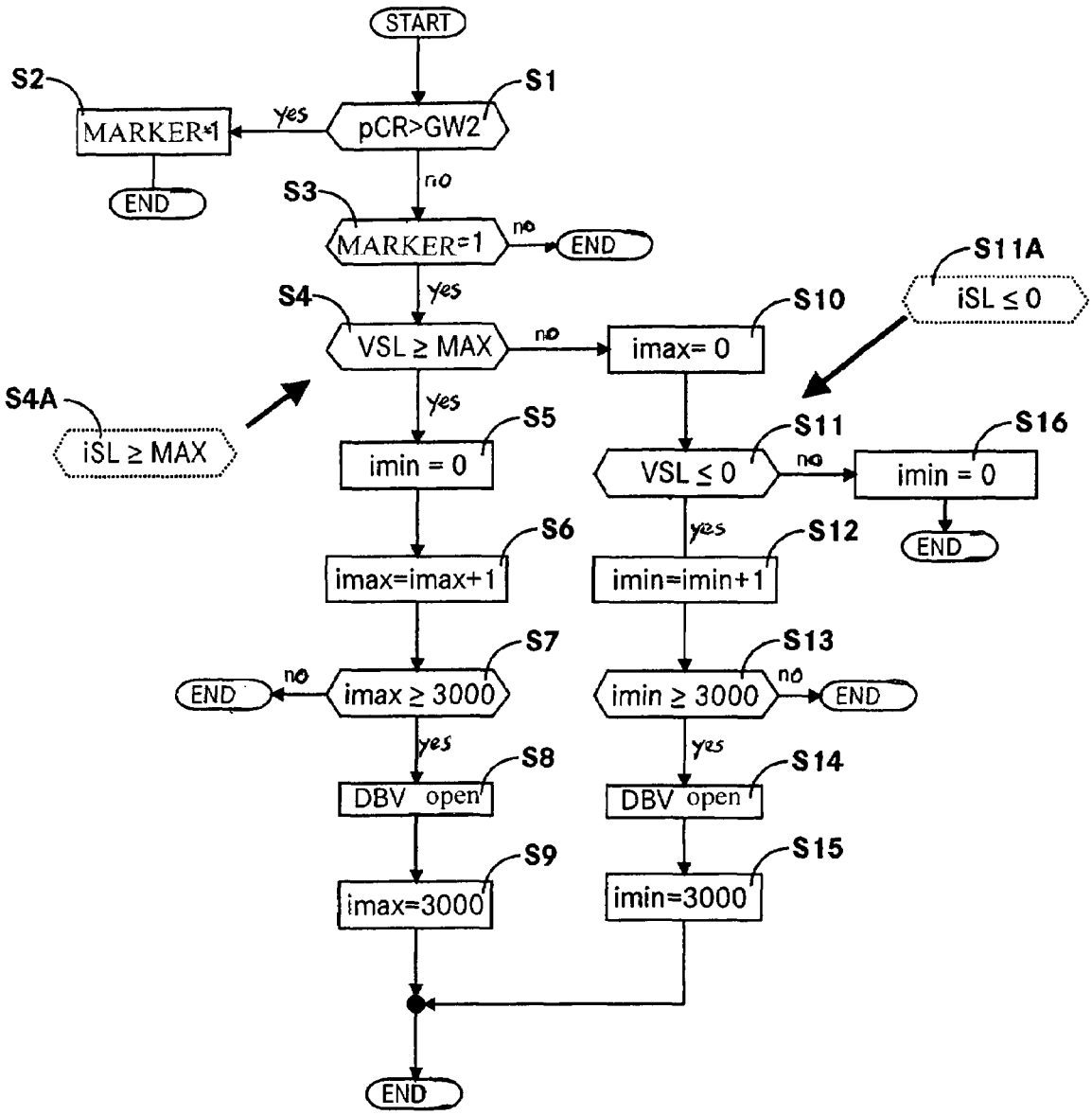
FIG. 10 shows a program cycle with respect to FIG. 9.

FIG. 10 shows a program cycle wherein the desired volume flow VSL is inquired as control value at S4 and S11. The references S4A and S11A shown in dotted lines represent the case wherein not the desired volume flow VSL but the desired current iSL is inquired as the control element. Therefore, in the description of FIG. 10, the reference to the desired volume flow VSL is also to be understood as a reference to the desired current iSL. The steps S5 to S9 are performed with a constant positive control deviation ep. With a constant negative control deviation ep, the steps S10 to S16 are followed.

After START, the program examines in S1 whether the rail pressure pCR is greater than the second limit value GW2, here: 1920 bar. If this is the case, at S2, the marker is set to the value one and this program part is terminated. If the examination at S1 indicates that the rail pressure pCR does not exceed the second limit value GW2, interrogation result at S1=no, at S3, the value of the marker is inquired. If it is zero, interrogation result S3=no, this program part is terminated. If the marker is one, interrogation result S3=yes, it is examined at S4, whether the desired volume flow VSL exceeds or equals the maximum value MAX, for example, 30 liter/minute. If this is the case, at S5, a first counter imin is set to zero and a second counter imax is increased by one S6. At S7, it is examined, whether the second counter imax exceeds or equals a final value, here 3000. With the final value 3000 and a sensing time of 10 ms a predetermined period of 30 s is obtained. If the counter position of the second counter imax exceeds the final value, interrogation result S7=yes, it is determined at S8 that the pressure limiting valve has opened. Then the second counter imax is set to its end value and this program part is terminated. If the examination at S7 indicates that the second counter imax has not yet reached the end value, interrogation result S7=no, this program part is terminated.

If it is determined at S4, that the desired volume flow VSL is less than maximum, interrogation result S4=no, at S10 the second counter imax is set to zero. Subsequently, it is examined at S11 whether the desired volume flow VSL is smaller than, or equal, zero. If this is the case, at S12 the counter position of the first counter imin is increased by one and it is examined at S13 whether it has reached the end value, here 3000. If this is the case, this program part is terminated. If the end value has been reached, interrogation result S13=yes, it is determined at S14 that the pressure limiting valve has opened and at S15, the first counter is set to the value 3000. Then this program part is terminated.

If the examination at S11 shows that the desired volume flow VSL is greater than zero, interrogation result S11=no, at S16, the first counter imin is set to zero and this program part is terminated.

In FIG. 10, the dotted reference items S4A and S11A represent the case wherein not the desired volume flow VSL but the desired current flow iSL is interrogated as central element. In accordance therewith, with a constantly positive control deviation ep, the steps S10 to S16 are followed. With a constantly negative control deviation ep, the steps S5 to S9 are followed.

The embodiments of the invention as represented herein may be combined. For example, an open pressure limiting valve can be recognized if the second limit value GW2, here 1920 bar, is exceeded and the rail pressure gradient GRAD becomes subsequently smaller than −5000 bar/s and subsequently a constant control deviation ep occurs or the desired volume flow VSL, or alternatively, the desired current iSL is at its minimum or, respectively, maximum value.

What is claimed is:

1. A method for detecting the opening of a passive pressure limiting valve (10) for releasing fuel from a common rail fuel injection system to a fuel tank (2) of a fuel supply system including a suction throttle (6), said method comprising the steps of: based on a stationary rail pressure (pER) present under normal operation, detecting a load reduction when the rail pressure (pCR) exceeds a first limit value (GW1), upon recognizing the load reduction, selectively, setting a PWM signal (PWM) for controlling the suction throttle (4) temporarily to a PWM value which exceeds the PWM value provided during normal operation, and recognizing the opening of the pressure limiting valve (10) if, as a result, the rail pressure (pCR) exceeds a second limit value (GW2) and further increases.

2. The method according to claim 1, wherein an opening of the pressure limiting valve (10) is confirmed when subsequently the rail pressure (pCR) drops with a negative gradient and the gradient is below a predetermined value.

3. A method according to claim 2, wherein the gradient is monitored over a pressure range extending between limit values (GW3, GW4).

4. The method according to claim 2, wherein the method is performed without temporary PWM increase.

5. The method according to claim 1, wherein an opening of the pressure limiting valve (10) is recognized when a control deviation (ep) between the desired rail pressure (pCR(SL)) from the actual rail pressure (pCR(IST)) is outside a predetermined tolerance band.

6. The method according to claim 5, wherein the opening of the pressure limiting valve (10) is recognized when the control deviation (ep) is outside the tolerance band over a predetermined period.

7. The method according to claim 1, wherein an opening of the pressure limiting valve (10) is recognized if a control value calculated by the pressure controller dependent on the control deviation (ep) corresponds over a predeterminable period to one of a fixed and an operation-dependent maximum or minimum value.

8. The method according to claim 7, wherein as control value one of a desired volume flow (VSL) and a desired current (iSL) is calculated.

9. The method according to claim 1, wherein the opening of the pressure limiting valve (10) is indicated to an operator.

10. The method according to claim 9, wherein an actuating instruction in the form of one of a performance reduction, the initiation of idle operation and an emergency stop is provided to the operator.

* * * * *